United States Patent [19]

Lenhardt

[11] Patent Number: 4,708,762

[45] Date of Patent: Nov. 24, 1987

[54] APPARATUS FOR JOINING TWO PANES OF GLASS TO FORM A FUSED SPACE WINDOW PANE

[75] Inventor: Karl Lenhardt, Neuhausen-Hamberg, Fed. Rep. of Germany

[73] Assignee: Lenhardt Maschinenbau GmbH, Neuhausen-Hamberg, Fed. Rep. of Germany

[21] Appl. No.: 897,493

[22] Filed: Aug. 15, 1986

[30] Foreign Application Priority Data

Aug. 17, 1985 [DE] Fed. Rep. of Germany ..... 3529520
Nov. 11, 1985 [DE] Fed. Rep. of Germany ..... 3539877

[51] Int. Cl.[4] ..... B65H 29/20

[52] U.S. Cl. ..... 156/556; 156/107; 156/109; 156/538; 156/578

[58] Field of Search ..... 156/556, 443, 578, 107, 156/109, 99; 538–539, 558, 559

[56] References Cited

U.S. PATENT DOCUMENTS 4,248,656 2/1981 Hofmann ..... 156/107 X
4,434,024 2/1984 Lisec ..... 156/107 X

FOREIGN PATENT DOCUMENTS 2710570 3/1977 Fed. Rep. of Germany ..... 156/107
2816437 4/1978 Fed. Rep. of Germany ..... 156/99

*Primary Examiner*—David Simmons
*Attorney, Agent, or Firm*—Balogh, Osann Kramer, Dvorak Genova & Traub

[57] ABSTRACT

This apparatus includes a horizontal conveyor (3, 4) that has separate supporting elements (9; 11, 12) to support the two panes of glass (31, 32), some of which define a plane of movement of the panes (10), whereas the others define a plane that is parallel to this, and which can be moved out of engagement with the pane of glass (31) that is arranged at a distance from the plane of movement of the panes (10), this being done either synchronously or in groups. In order to inject a paste-like material between the two panes of glass (31, 32) there is at least one nozzle (36) which can be moved parallel to the plane of movement of the panes (10) transversely to the direction of movement (x) of the horizontal conveyor (3, 4). A separator that precedes the nozzle orifices of the nozzle (36) at a constant distance is provided, this penetrating into the space between the two panes of glass (31, 32).

31 Claims, 31 Drawing Figures

Section A - B

Figure 1:
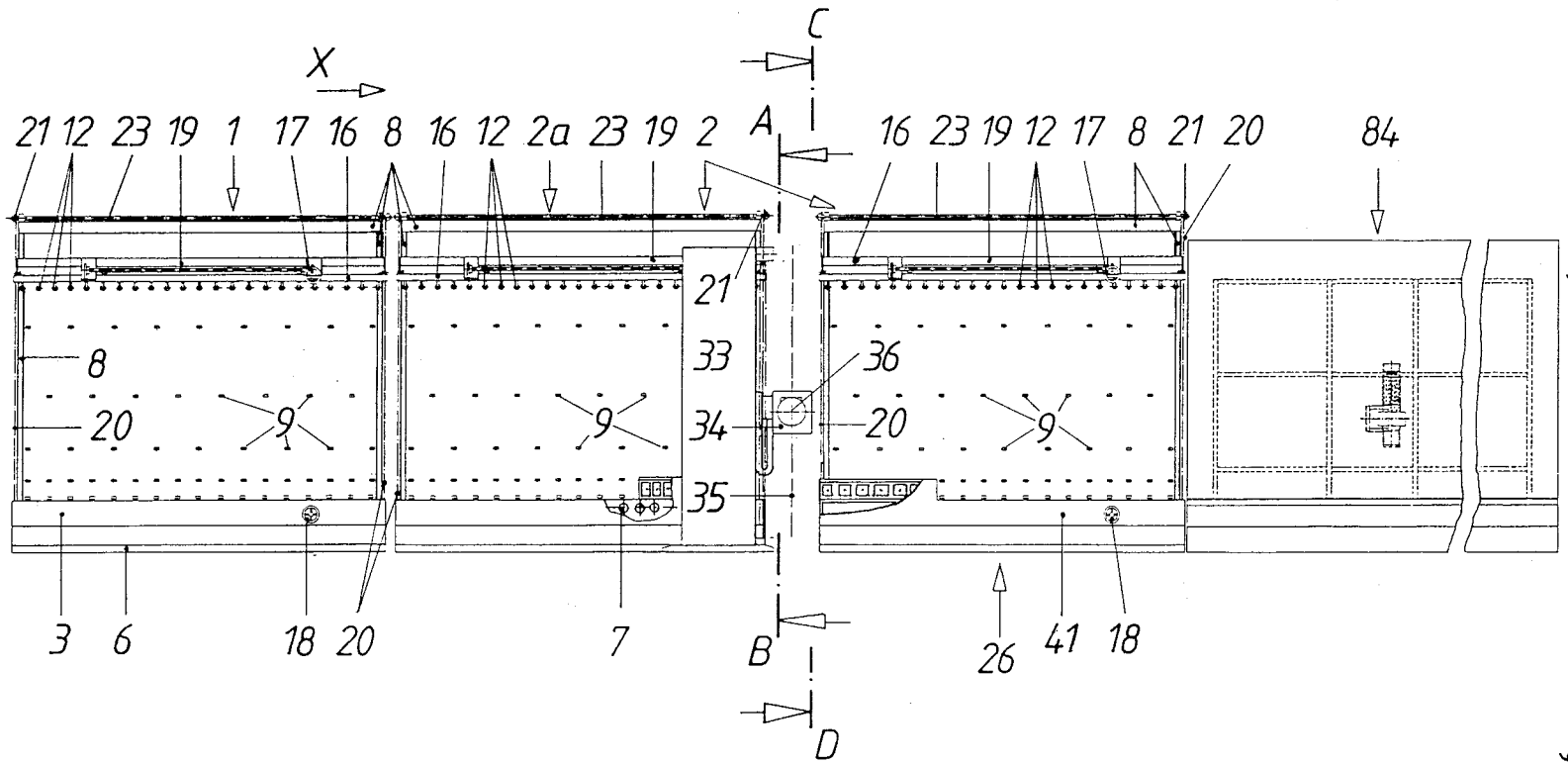

Section C - D 21
10
19
16
17
20
8
9
32
31
2b
10
25
22
73
74
81
80
6
70b
70a
75
73
74
12
32
31
16
31
72
71
74
76
32
81
83
81
82
80

APPARATUS FOR JOINING TWO PANES OF GLASS TO FORM A FUSED SPACE WINDOW PANE

The present invention proceeds from a device with the features set out in the defining portion of claim 1.

Such an apparatus is known from DE-OS No. 23 10 502.

In this known apparatus, the two panes of glass that are to be fused together are clamped together with a distance piece in the form of a clip or a block between them and then, standing on a horizontal conveyor and leaning against a set of supporting rollers, are moved with their lower edge above a stationary nozzle, from which a hot-melt material emerges and enters the space between the two panes of glass in the form of a strip, whereupon the edges of this strip adhere to the opposing panes of glass. Once a strip has been installed along one edge of the pair of panes that are clamped together and has done so to the full length of the edge, the forward movement of the panes of glass is halted and the supply of hot-melt material is interrupted; the two panes of glass are then pivoted as a unit through 90° about an axis that is perpendicular to the plane of movement of the panes, whereupon a further strip of hot-melt material is injected into the edge area that is now at the bottom.

This procedure is repeated for the third edge of the pair of glass panes that are clamped together, this being done in the same manner; then the distance piece is removed from the space between the two panes of glass; the two panes of glass, which are now connected by the hot-melt material alone, are rotated for a third time through 90° and then the strip of the hot-melt material is injected into the remaining edge, whereupon the space between the two panes of glass is tightly sealed; these panes now form a pane of insulating glass.

In a particular embodiment of the known device, there are rollers on both sides of the plane of movement of the panes, and these, at the moment that the hot-melt material is injected, exert a slight pressure on the outer surfaces of the two panes of glass, in order that the distance between them remains constant.

In this known device, it is a disadvantage that the two panes of glass that are to be joined together have to be clamped together before the hot-melt material is injected, and a distance piece has to be inserted between them, and further that this distance piece has to be removed before the injection of the last strip of hot-melt material, which is inconvenient. A rational, automatic joining of two panes of glass is impossible in this manner. Furthermore, it is a disadvantage of the known apparatus that the two panes of glass that are clamped together have to be rotated three times through 90°, since this makes a pivoting system necessary and this, particularly in the case of large panes of glass, has to be built at great expense, quite apart from the fact that a relatively large amount of time and space is needed to pivot the panes of glass.

It is the task of the present invention to create an apparatus of the type described in the introduction hereto, in which it is not necessary to rotate the panes of glass and which provides for a rational, automated joining of the panes of glass to form a pane of insulating glass.

This task has been solved by means of an apparatus with the features that are described in claim 1. Effective developments of the invention form the object of the sub-claims.

It is an important feature of the present invention that the horizontal conveyor has separate supporting elements that are provided to support the two panes of glass on its major surface, and of these, some define the plane of movement of the glass, whereas the others define a plane parallel to this. Here, the plane of movement of the panes is understood to be a plane that is parallel to the panes of glass which, when the panes of glass are moved on the horizontal conveyor, coincides with the outer major surface of one of the two panes of glass, and in the case of panes of glass that are moved horizontally, corresponds to the lower major surface of the lower pane of glass and, in the case of a horizontal conveyor, on which the panes of glass stand and are moved whilst leaning against the supporting elements, define the rearmost major surface of the rear pane of glass.

Supporting elements for the rear major surface of the rear pane of glass are also seen in the horizontal conveyor that is known from DE-OS No. 23 10 502. In this known device, however, the front pane of glass is supported by the distance piece that is clamped between the two panes. The present invention uses separate supporting elements instead of this clamped-in distance piece, and these are arranged on the horizontal conveyor in such a manner that they define a plane that is parallel to the plane of movement of the panes, which means that they hold the second pane of glass at a specific distance from the first pane, that lies in the plane of movement of the panes, whereas the two panes of glass are delivered synchronously on the horizontal conveyor and/or can be joined to each other by the injection of material that is initially in paste form and subsequently hardens, this being injected into the space between the two panes. Hot-melt adhesives or thiokols are suitable as the materials used for this purpose.

In order that the two panes of glass that are to be joined do not need to be rotated, in contrast to the known device the apparatus according to the present invention incorporates a nozzle that can be moved parallel to the plane of movement of the panes, transversely to the direction of movement of the horizontal conveyor. Fundamentally, it is possible to use one nozzle, although a plurality of such nozzles can be provided, these being used in sequence or in part simultaneously to inject the paste-like mass into the space between two panes of glass. In the event that a plurality of nozzles are provided then at least one of them is to be moveable in the manner described. If only one nozzle is used, this can be used to process the two edges of the pair of glass panes that are transverse to the direction of movement whilst the panes of glass are at rest, whereas the two edges of the pair of panes that are parallel to the direction of movement can be processed when moving past the stationary nozzle. Apparatuses that work with one or two nozzles are described in greater detail below on the basis of the drawings appended hereto. Further possible arrangements of nozzles and their patterns of movement, including those in which one nozzle is moveable in the direction of movement or against the direction of movement of the panes of glass, in order to permit sealing of the edges of the stationary pairs of panes that are parallel to the direction of movement, are described in DE-PS No. 28 16 437 and DE-PS No. 28 46 785; these can be related to the present invention insofar as they relate to work on panes of insulating glass that do not have to be rotated when being processed. In particular, it is also possible to provide two nozzles that can be moved on parallel paths obliquely to the direction of movement, parallel to the plane of movement of the panes and which can be pivoted about an axis that is perpendicular to the plane of movement of the panes, as is shown in DE-PS No. 28 16 437, in the second embodiment. The advantage in such an arrangement lies in the fact that the two nozzles begin their work simultaneously or nearly simultaneously on one first common corner and simultaneously or nearly simultaneously end this work at the opposite corner, so that the two strips that are produced by them are connected to each other at both ends, as long as they are both fresh (hot), which makes it very easy to achieve a tight connection of the two strips.

In order to permit the unhindered passage of the relevant nozzles on the edge of the panes of glass, the supporting elements for the panes of glass that are arranged at a distance from the plane of movement of the panes can be moved either singley or collectively out of engagement with this pane of glass by means of an operating system. This operating system can be controlled automatically very simply, if sensors are provided that transmit information about the position of the particular pair of panes and the nozzles. In that edge area of a pair of panes in which the initially paste-like and then hardening mass has already been injected, this mass itself can provide the necessary support for the panes of glass that are arranged at a distance from the plane of movement of the panes, in place of the supporting elements that have already been moved out of engagement.

In addition, according to the present invention it is foreseen that a spacer is provided, this spacer penetrating into the space between the two panes of glass and moving at a constant distance ahead of the nozzle openings, and holding the two panes of glass at the necessary distance from each other in the vicinity of the nozzle orifices and ensuring that the strip of the paste-like mass that is injected between the panes is of the exact width that corresponds to the distance between the panes of glass. In the event of panes of glass that are arranged either horizontally or inclined, the weight of the upper or front pane that is arranged at a distance in front of the plane of movement of the panes can be used to ensure that when they are in the vicinity of the nozzle the two panes of glass are not separated by an interval that is greater than required and provided by the distance piece. However, it is preferable that pressure elements, in particular rollers, are provided on both sides of the spacer, by means of which the two panes of glass can be pressed against the spacer when the paste-like mass is injected.

The present invention can also be applied to apparatuses with a horizontal conveyor on which the panes of glass are moved horizontally, i.e., when lying flat, as well as in apparatuses with a horizontal conveyor on which the panes of glass are moved vertically, i.e., when standing upright. In the case of panes of glass that are moved when horizontal, the upper pane has a tendency to sag in the middle; in order to counteract this, in such an apparatus it is preferable to provide a suction system that can be moved parallel and transversely to the plane of movement of the panes, above the plane of movement of the panes, e.g., a suction cup that can be applied to the upper pane of glass in order to compensate for this sag by means of suction. For this reason, the suction system is so configured as to be moveable parallel to the plane of movement of the panes, in order that it can be positioned approximately in the middle of the pane of glass in the case of alternating formats of the panes of glass. However, an apparatus through which the panes of glass move on a vertical conveyor in an upright position and inclined slightly towards the vertical against the supporting elements is preferred, for with this type of configuration the passage of the front pane presents no special problem and the footprint of the apparatus is far smaller than in the case when the glass panes are processed when horizontal. It is advantageous to use rollers as the supporting elements, these reaching into the space between the two panes of glass and rolling on the inner side of the pane of glass that is arranged at a distance from the plane of movement of the panes. In this connection, it is in no ways essential that the rollers protrude completely into the space between the two panes; it is sufficient if they do this with only a portion of their circumference. Tapered rollers that protrude into the space between the panes of glass with only the portion of their circumference that is of a greater diameter and which can be used even in the case of a small gap between the two panes, are preferred. In place of rollers, it would also be possible to use pegs to support the pane of glass that is arranged at a distance in front of the plane of movement of the panes; these pegs would then protrude into the space between the two panes of glass. However, these pins should be of a material that has a very low coefficient of friction, or should be driveable synchronously with the horizontal conveyor in order that excessive friction is not generated when the panes of glass are moved. If the supporting elements are rollers, these can be so configured as to be free-wheeling although it is, of course, possible to configure them so as to be driven in order that they can contribute to the forward movement of the panes of glass on the horizontal conveyor.

It is not necessary that the supporting elements support the panes of glass over a greater area of their particular major surface; it is quite sufficient that the panes of glass be supported only at their edges, in particular, on the two edges that extend in the direction of movement of the horizontal conveyor. To this end, two rows of supporting elements are provided to support the pane of glass that is arranged at a distance from the plane of movement of the panes, these being parallel to the direction of movement of the horizontal conveyor, and in particular are supporting rollers of which at least one row is moveable parallel to the plane of movement of the panes, transversely to the direction of movement, in order that the apparatus can be matched to varying formats of the panes of glass. With the preferred use of a horizontal conveyor for panes of glass that are moved when vertical, it is best to use a lower line of supporting elements that project only slightly above the plane of support of the horizontal conveyor, and a second line of supporting elements that are arranged above this, the height of which can be adjusted, in which connection the supporting elements of the lower line can preferably be made to sink below the plane of support of the horizontal conveyor.

In order to match the varying thicknesses of panes of insulating glass, the distance of the supporting elements for the front or upper pane of glass is preferably variable from the plane of movement of the panes.

The pressure elements that are arranged on both sides of the spacer can, in the simplest case, be acted upon by mechanical springs. However, it is preferred that a pneumatic piston-cylinder unit or an operating system that works in a similar manner be provided, this making it possible to press the pressure elements against the panes of glass deliberately, and to remove them from it deliberately. In particular, such an operating system makes it possible to achieve a match to different thicknesses of panes of insulating glass. Since, even in the case of different thicknesses of panes of insulating glass, the outer side of one pane is always in the plane of movement of the panes, then there is no need to arrange the pressure element that has a surface that exerts the pressure in the plane of movement of the panes so as to be transversely moveable, even though it can be extremely advantageous to support it such that it can be moved transversely to a limited extent, or, in particular, so that it is flexible. In order to accommodate various thicknesses of insulating glass panes it is sufficient if the opposite pressure element or pressure elements can be moved transversely to the plane of movement of the panes. It is preferred that the piston rod of the piston-cylinder unit be connected with the pressure element or pressure elements on the one side, and the cylinder be connected with the pressure element or elements on the other side of the plane of movement (an overhung connection), in which connection it is more expedient to provide only a limited displacement path for the pressure elements, the surfaces of which exert the pressure are to lie in the plane of movement of the panes, whereas a somewhat greater path of movement should be provided for the opposite pressure elements.

The nozzle and its associated spacers can be discrete components, although it is preferred that the two be arranged on a common carrier; in particular, the nozzle itself can form the spacer. Since the spacer is in contact with both panes of glass and moves relative to the panes of glass when the paste-like mass is being injected, it is expedient that the sides of the spacer be of a plastic that has a low coefficient of friction. In addition, it is also expedient that the spacer be tapered, in order to simplify insertion into the space between the two panes of glass. It is not always necessary to have the spacer in the space between the two panes of glass in order to produce a strip of the paste-like mass between the two panes of glass; a non-penetrating nozzle is also shown for the apparatus that is known from DE-OS No. 23 10 502. However, it is preferred that the nozzle penetrate the space, this being done in such a manner that the nozzle orifice is directed against the direction of relative movement of the nozzle in relation to the panes of glass. An arrangement of this kind is suitable for the production of an even and rectilinear strip.

If it is not desired to provide a separate nozzle for the injection of the paste-like mass along the four edges of the pane of glass, at least one nozzle that can be moved transversely to the direction of movement of the horizontal conveyor will have to be provided, this being rotatable about an axis that is parallel to the plane of movement of the panes, at least once, and preferably repeatedly so that it can be brought to rest against the pane of glass in sequence, on a plurality of edges.

With regard to a construction of the apparatus that is as simple as possible, it is advantageous if the nozzle, the spacer (insofar as the nozzle itself is not the spacer) and the pressure elements are arranged on one common carrier and are moveable and pivotable with this.

The cross sectional shape of the nozzle orifices will depend on the type or kind of strip that is to be produced. It is preferred that a two-layer connecting strip of two different components be produced, in which connection both layers will extend from one to the other pane of glass and the first layer will be of a material which adheres to the panes of glass but which is not water-vapour-proof and which has a granular drying agent (for example, a molecular sieve) embedded in it, this being able to bond with any moisture that is present in the interior of the pane of insulating glass in contrast to which the second outermost layer contains no drying agent and in place of this, seals the inner space of insulating glass against the outer atmosphere absolutely tightly. It is possible to produce such a connecting strip by means of a nozzle which has two outlet orifices that are closely adjacent to each other, to which the various materials are passed through special feed channels, or by one nozzle which has only one outlet orifice in which there are however two feed channels for the two various materials. It is preferred that the two feed channels merge obliquely with each other in the outlet orifice in order to ensure that the two-part strips can bond with each other.

In the case of a non-penetrating nozzle, the two outlet orifices or the confluence of the two feed channels are to be arranged in the alternatively provided one outlet opening of the nozzle relative to the direction of movement of the nozzle, one behind the other in relation to the panes of glass; if a penetrating nozzle is used in which the two outlet orifices are oriented opposite to the direction of movement of the nozzle relative to the panes of glass, the two outlet orifices are oriented naturally so that they are adjacent to each other at the same distance from the plane of movement of the panes.

In a device according to the present invention in which the panes of glass are connected whilst standing by means of at least one nozzle that can be pivoted about an axis that is perpendicular to the plane of movement of the panes, by 90° in each instance, and which has two lines of supporting elements to support the front pane of glass, it is advantageous to use a horizontal conveyor that has two separate driveable sections, one behind the other, in which connection within the first section of the horizontal conveyor there are supporting elements for the major surface of the pane of glass that lies at a distance from the plane of movement of the panes which are adjustable separately from those in the second sector, and the first sector of the horizontal conveyor together with its supporting elements for the two panes of glass is adjustable in a direction that is perpendicular to the plane of movement of the panes. Within the first sector of the horizontal conveyor, the two panes of glass that are to be joined can be aligned over each other at a prescribed distance and then moved into the second sector together. An example for the first sector of the horizontal conveyor is described in DE-OS No. 28 20 630. The method of operation used herein will be described in detail below, on the basis of the drawings appended hereto. One nozzle is best used for injecting the paste-like mass into the space between the two panes of glass which, in the manner that is claimed, is moveable and progressively pivotable about 90°, or else two nozzles are used, of which one is moveable and progressively pivotable about 90° in the manner claimed, whereas the other is arranged at the level of the vertical conveyor and is provided only to produce a strip along the lower edge of the panes of glass. This one nozzle or these two nozzles can be arranged between the two sectors of the horizontal conveyor described in the preceding paragraph. However, it is preferred that they be arranged next to the second sector of the horizontal conveyor so that a third sector of the horizontal conveyor can be positioned adjacent thereto; this last-named embodiment entails the advantage—vis-à-vis the previously cited embodiments—that it permits a significantly shorter cycling time for the apparatus for, while one pair of panes of glass is being manipulated and joined to each other by injection of the paste-like mass in the area of the second and third sectors, the following pair of panes can be aligned one above the other in the first sector of the horizontal conveyor while this is being done.

It is expedient that the first sector of the horizontal conveyor have two separate vertical conveyors for the two panes of glass that are to be positioned one above the other, these being separate, and arranged parallel to each other, preferably separately or synchronously driven, which bring in the two panes of glass separate from and following each other and align them so as to cover each other at a distance; next, the two panes of glass can be moved together into the second sector of the horizontal conveyor.

Insofar as the paste-like mass is injected into the space between the two panes of glass so as to join them along their edges, care must be taken that the material that is injected into the lower edge areas does not remain stuck to the vertical conveyor when the panes are removed from the area of the nozzles. This can be prevented as is shown in DE-OS No. 23 10 502, in that the panes of glass are slid on their lower edges across a cool block which ensures a rapid hardening of the injected material and/or in that a strip is supplied which is used to cover the lower edge joint in the area into which the paste-like material has already been injected, this being done progressively. Another possibility lies in the fact that a special vertical conveyor can be provided in the sector of the horizontal conveyor that is adjacent to the nozzles, this having supports that act under the panes of glass and preserve the lower edge joint. Examples of such vertical conveyors are described in DE-PS No. 30 38 425 and in DE-PS No. 34 00 031. Such a vertical conveyor can be used advantageously both in an embodiment of the apparatus according to the present invention with only one nozzle and in an embodiment that has two nozzles.

If a nozzle injects a strip of paste-like material along the upper or lower edges, into the space between a pair of glass panes while this pair of panes is being moved on a powered vertical conveyor through the apparatus and the nozzle is stationary, the nozzle will exert a retarding moment on the pair of glass panes. In order to ensure that the pair of glass panes moves smoothly through the apparatus under all circumstances, and to ensure the even sealing of the insulating glass panes at the same time, an advantageous development of the invention foresees that the horizontal conveyor has at least one auxiliary conveyor that can be driven synchronously with the vertical conveyor, this being above the vertical conveyor and being intended for attachment to the upper edge of the glass pane or to another major surface of the glass pane, thereby moving the panes by pushing them or pulling them in addition to the vertical conveyor. The glass panes can be slid along in the direction of movement (x) by means of a stop that acts on the rear edge of the glass panes and can be slid counter to the direction of the movement (x) by means of a stop that acts on the front edge of the glass panes, it being possible to move this from an inactive position behind the plane of movement of the panes into an effective position, or can be so pivoted. However, it is preferrable to provide an auxiliary conveyor that acts on the outer major surfaces of the glass panes, in particular one which is formed from suction-type conveyors that are arranged on both side of the plane of movement, opposite one another. These can be in the form of suction cups, that can be set on both the outside major surfaces of the panes of glass and which move the glass panes in addition to the driven vertical conveyor, synchronously with this. Particularly suited, however, are suction conveyor belts such as those described in the former German patent application No. P 35 29 892.8 and in the patent application submitted on this same date by Herr Karl Lenhardt and entitled "An Apparatus for the Smooth Conveyance of Articles in any Position, in Particular in an Inclined or in a Vertical Position." It is preferred that such an auxiliary conveyor be provided in front on the path of movement of the nozzle that can be moved transversely to the direction of movement, and a further auxiliary conveyor be provided behind on the path of movement of the nozzle that can be moved transversely to the direction of movement, in order to ensure thereby that the required smooth movement is ensured without any transition from one phase to the other of the sealing process.

Figure 2:
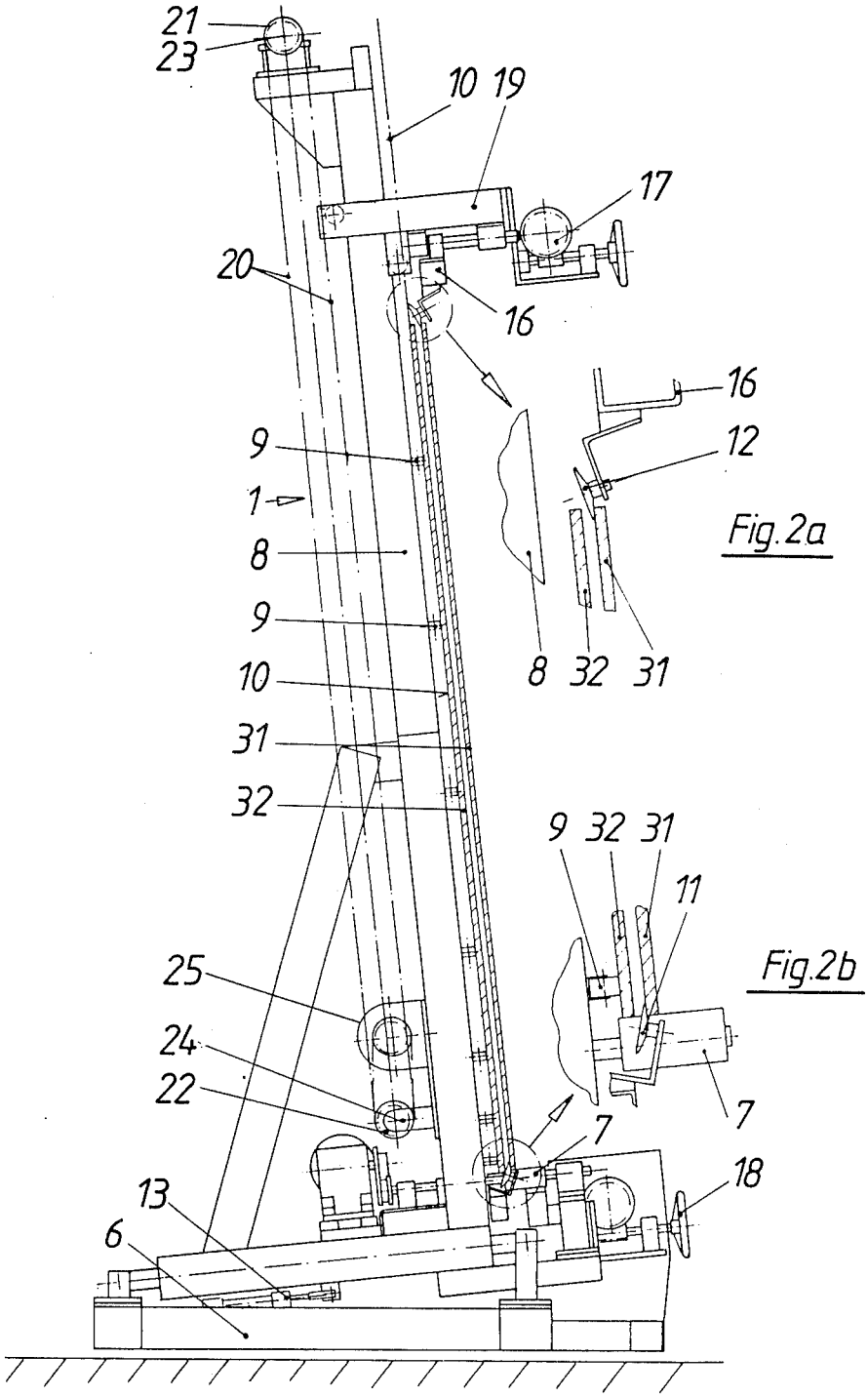
Figure 3:
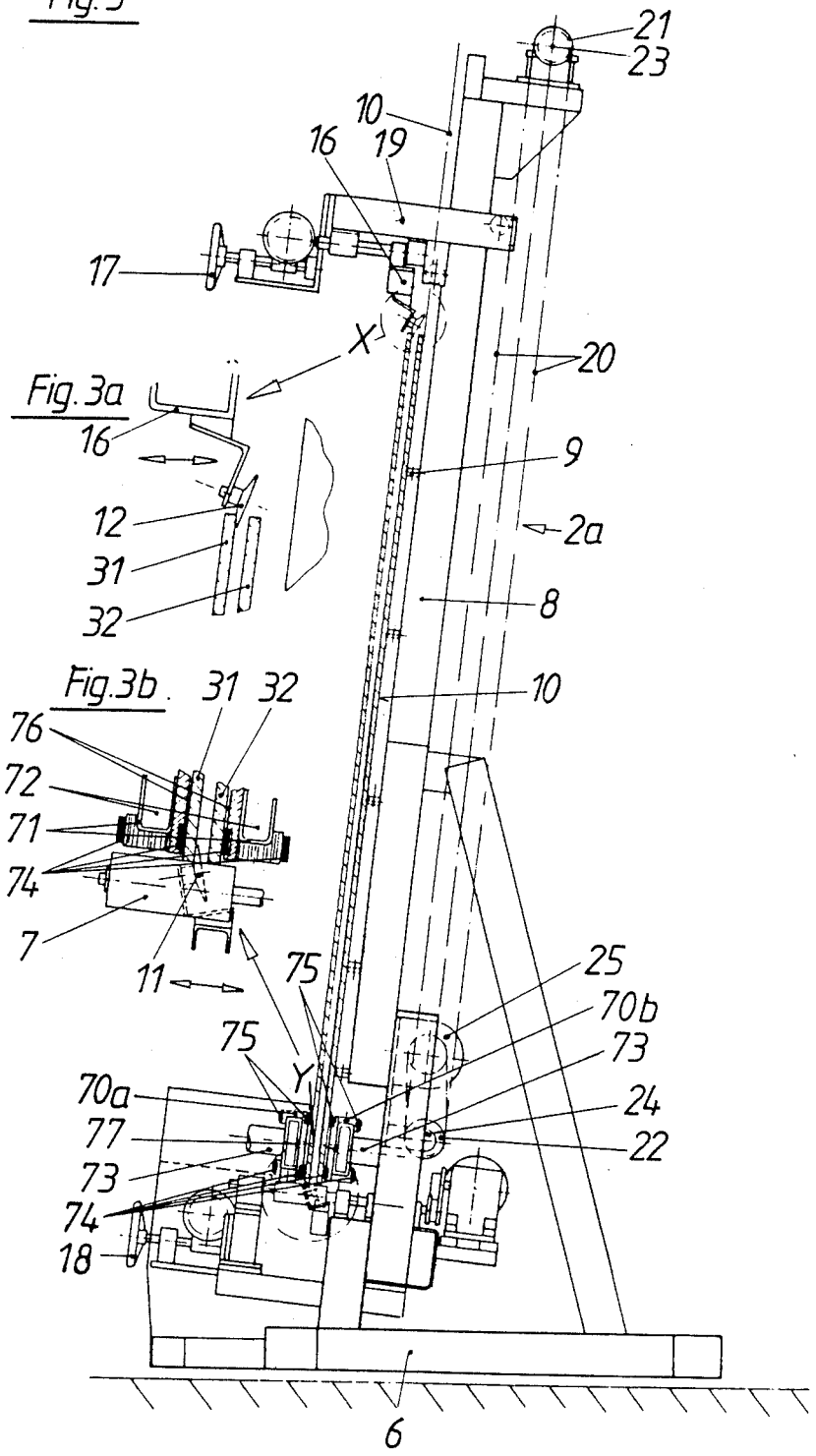
Figures 4, 4A, 4B:
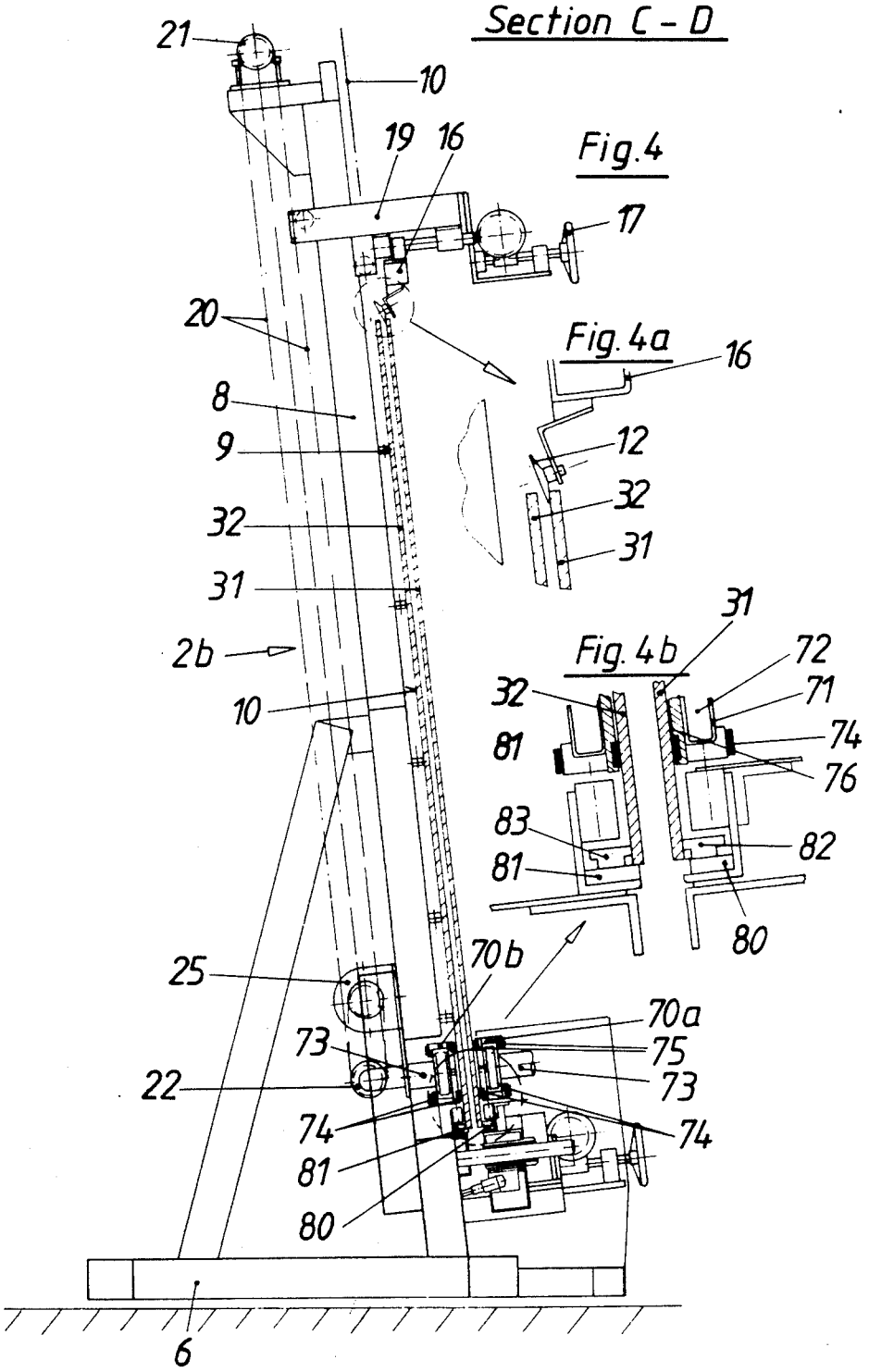
Figure 6:
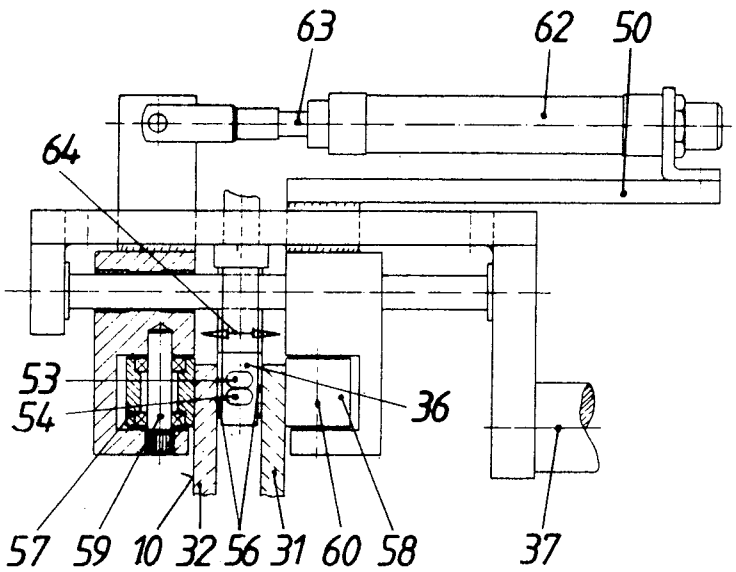
Figure 5:
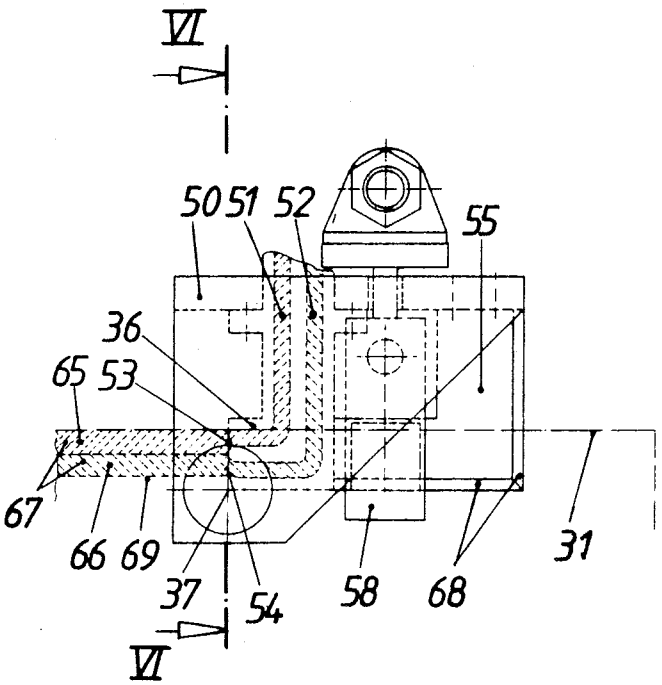
Figure 7C:
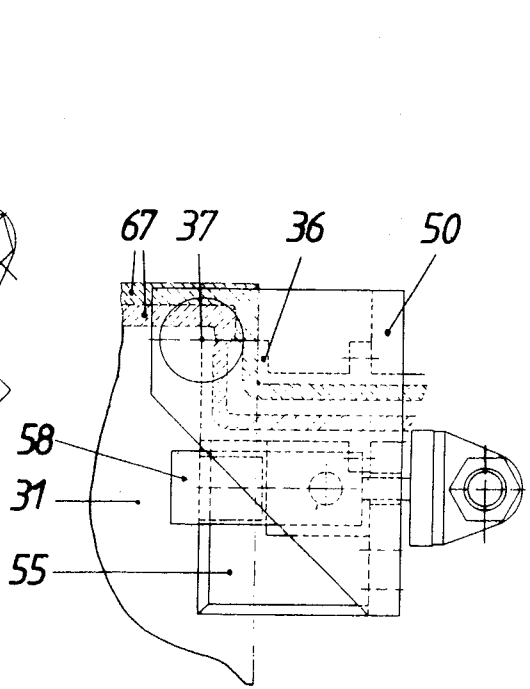
Figure 7B:
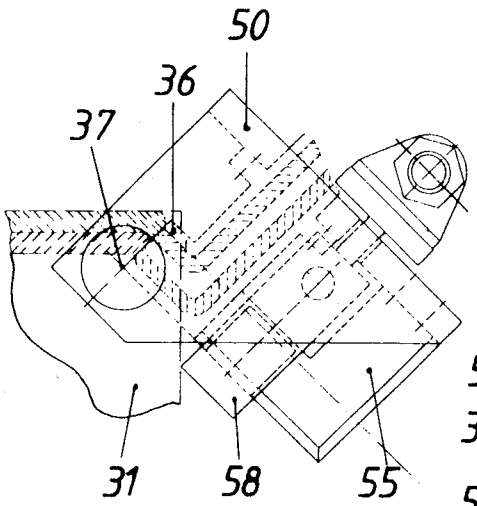
Figure 7A:
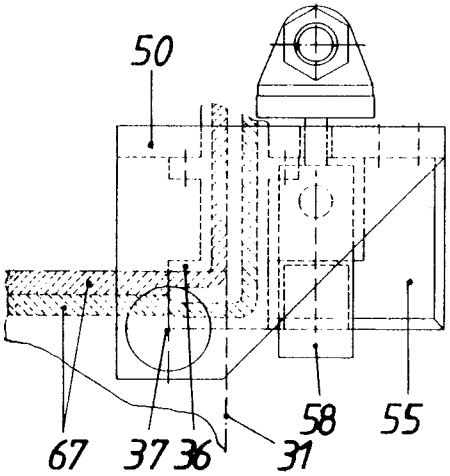

The construction of an apparatus which operates with only one nozzle, and an apparatus which works with two nozzles is described in greater detail below, on the basis of the schematic drawings appended hereto. These drawings are as follows:

FIG. 1: is a front view of a portion of a production line for insulating glass window panes, this containing the apparatus according to the present invention, and which operates with only one nozzle;

FIG. 2: shows a side view x as in FIG. 1 (viewed in the direction of movement);

FIGS. 2*a* and 2*b*: show the same view as in FIG. 2, although at a greater scale, as detail of the way in which the front pane of glass is supported on the lower or the upper edge in the pairing station shown in FIG. 2;

FIG. 3: shows the view A–B as in FIG. 1 (viewed in a direction opposite to the direction of movement);

FIGS. 3*a* and 3*b*: show the same view as in FIG. 3, although at a larger scale, as a detail of the manner in which the glass panes are held or supported on the upper or lower edge in the portion of the sealing station that is shown in FIG. 3;

FIG. 4: shows the view C–D as in FIG. 1 (viewed in the direction of movement);

FIGS. 4*a* and 4*b*: show the same view as in FIG. 4, although at a larger scale, as detail of the manner in which the glass panes are supported or held on the upper or lower edge in the section of the sealing station that is shown in FIG. 4;

FIG. 5: shows as a detail the manner in which the nozzle penetrates the upper edge joint between two panes of glass, this being in a front elevation;

FIG. 6: shows the cross section VI—VI as in FIG. 5;

FIG. 7: shows a side view as in FIG. 5 of the progression of the nozzle as it moves around the corners of the panes in three sequential phases A, B, and C;

FIGS. 8 to 16: present a plan view of a production line for panes of insulating glass that contains the apparatuses shown in FIGS. 1 to 7, and the manner in which an insulating pane of glass is assembled, and FIGS. 17 to 23: show in a manner similar to FIGS. 8 to 16 the manner in which an insulating pane of glass is assembled in an assembly line, this operating with two nozzles.

The apparatus that is shown in FIG. 1 consists of a pairing station 1, a sealing station 2 that incorporates two sequential sections 2*a* and 2*b*, and a removal station 84.

Within the pairing station, panes of glass that arrive singley in the transport system (as indicated by the direction of the arrow x) are paired, i.e., they are positioned at a specific distance from each other so that their outlines coincide. To this end, there is in the pairing station 1 of the first section 3 of a horizontal conveyor, which is secured to the machinery frame 6, a vertical conveyor that is formed by a line of synchronously driven rollers (FIG. 2); in addition, above the vertical conveyor 7 there is a field of free-wheeling support rollers 9 that are arranged in a frame 8 that is fixed to the (machinery) frame and these rollers 9 define a plane of movement of the panes 10; these also include two lines of tapered supporting rollers 11 and 12 that are parallel to the vertical conveyor 7, and these define a second plane that is parallel to the plane of movement of the panes 10. The frame 8 is inclined rearwards by a few degrees from the vertical and the plane 10 is also inclined by the same amount. The support rollers 9 have axes that are almost perpendicular and parallel to the plane of movement 10 of the panes. The axes of the rollers 7 of the vertical conveyor extend at a right angle to the plane of movement 10.

The machine frame 6, together with the frame 8, is supported so as to be able to slide by means of a piston-cylinder unit 13 in a direction that is perpendicular to the plane of movement 10. The lower support rollers 11 have their upper edge slightly above the supporting plane that is defined by the rollers 7 of the vertical conveyor. The upper supporting rollers 12 are attached to a horizontal beam 16 that is arranged so as to be able to slide up and down on the frame 8. The distance of the two support roller lines 11 and 12 from the plane of movement of the panes 10 can be changed by means of the adjuster system 17 or 18.

The beam 16 with the upper line of support rollers 12 and the associated adjusting system 17 are all secured to a cross-beam 19 that is supported on the two side pillars of the frame 8. In order that the cross-beam 19 can be moved up and down, this is connected at both ends with a chain 20 that passes upwards over an upper guide sprocket 21 and from there passes downwards over a lower guide sprocket 22 and then back up again to the cross-beam 19. The two guide sprockets 21 that are arranged above are connected rigidly to each other through a shaft 23 and the lower two guide sprockets 22 are connected rigidly to each other by means of a shaft 24. The lower shaft 24 is driven by a motor 25.

The panes of glass are moved to the pairing station 1 as is shown in FIG. 1, from the left. To this end, before the pairing station 1 there are, for example, a supply conveyor, a washer 27, and an intermediate conveyor 28 to which the pairing station 1 is adjacent (see FIG. 8). The panes of glass are passed singley to the supply conveyor; they then pass through the washer 27 in a vertical position and move to the intermediate conveyor 28 from which they are moved into the pairing station 1. Of course, the supply conveyor, washer 27 and the intermediate conveyor 28 have planes of movement for the panes which coincide and their vertical conveyors are at the same height as those in the pairing station 1.

Figure 8:
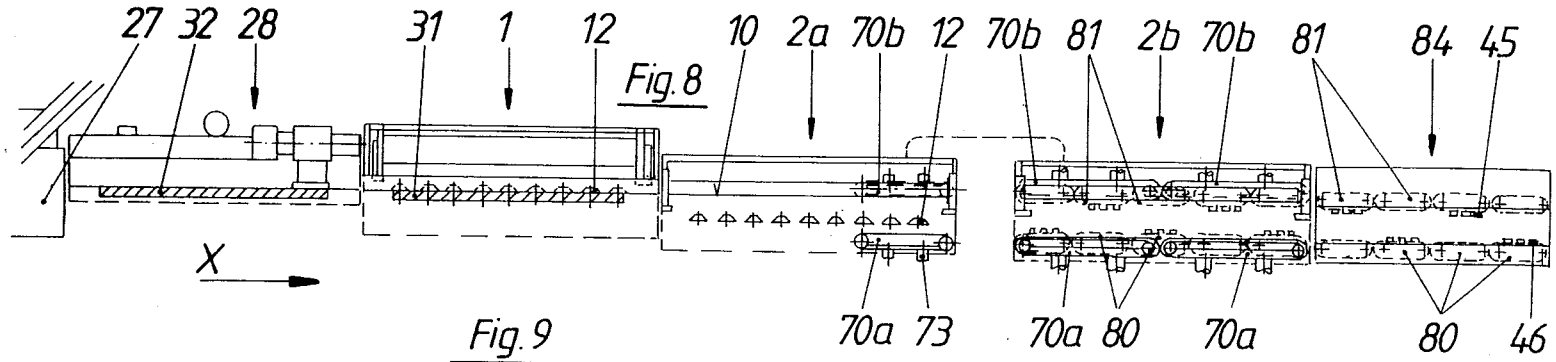

Before the first pane of glass 31 of a pair moves into the pairing station 1, it is brought into such a position by the piston-cylinder unit 13 in which the second plane that is defined by the supporting roller lines 11 and 12 coincides with the plane of movement of the panes 10 of the intermediate conveyor 28. Thus, the first pane of glass 31 rolls on the rollers 11 in a standing position and leans against the support rollers 11 and 12 as it moves into the pairing station 1, and is held in a pre-determined position, in particular with its front vertical edge against a stop (not shown herein) which can be withdrawn. This position is shown in FIG. 8. The second pane of glass 32, which is to be aligned with the first pane 31 has in the mean time moved into the intermediate conveyor 28. Before this can move into the pairing station 1, its frame 8 is moved by operation of the piston-cylinder unit 13 such that the plane of movement of the panes which is defined by the supporting rollers 9 aligns with the plane of movement 10 of the intermediate conveyor 28 (the plane of movement 10 extends through all the stations of the production line). The pane of glass 32 that moves into the pairing station is thus supported by the rollers 9 that are mounted on the frame 8 and moves forward in the direction of movement between these supporting rollers 9 and the first pane of glass 31 until it reaches the same longitudinal position as the first pane 31, until it is held, most expendiently, by the same stop. It is now positioned so as to be aligned with and coincide with the first pane of glass 31.

The second pane of glass 32 can now be moved into the pairing station 1 fundamentally by the same rollers 7 on which the first pane 31 is standing, since this can be secured by means of the stop against which it has run. In order to avoid the friction that is generated by the rollers 7 on the first pane of glass 31 when this is done, it can however be expedient to provide separate drive rollers that are coaxial and adjacent to each other, these being connected to each other, for example, by means of a slip clutch as is indicated in DE-OS No. 28 20 630.

In order that the support rollers 11 and 12 can still fit into a small space between the two panes of glass 31 and 32, they can be configured so as to be conical and extend—as is shown in detail in FIGS. 2*a* and 2*b*—only slightly into the space between the two panes 31 and 32, in which connection they will then support the first pane 31 with their conical bearing surfaces.

It is also possible to assemble panes of insulating glass of varying formats in the assembly line. If panes of glass of varying heights follow one after the other, their heights can be established by means of sensors which are located, for example, in the area of the intermediate conveyor 28, and the level of the line of supporting rollers 12 can be moved to the level that corresponds to the measured height before the first pane of a pair of panes is moved into the pairing station 1.

Figure 9:
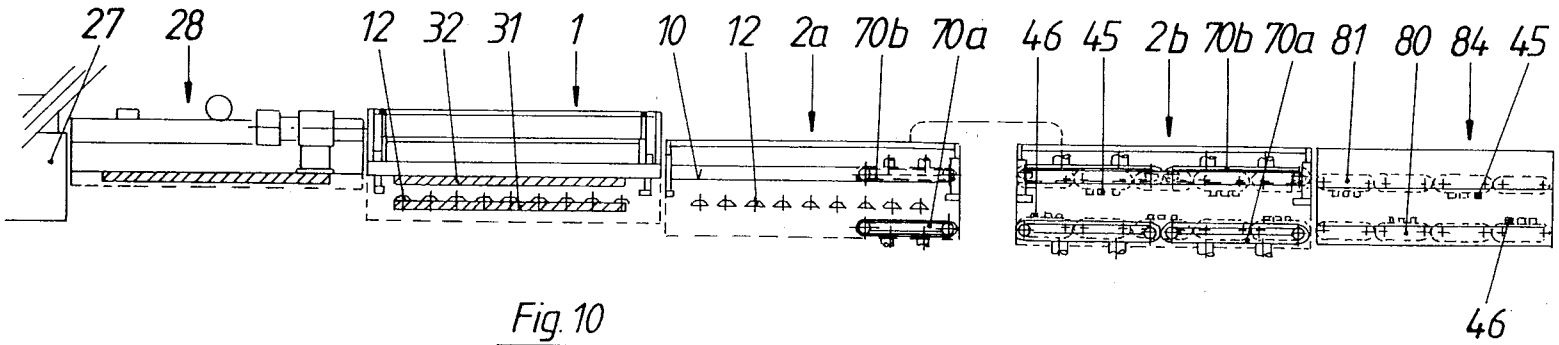
Figure 10:
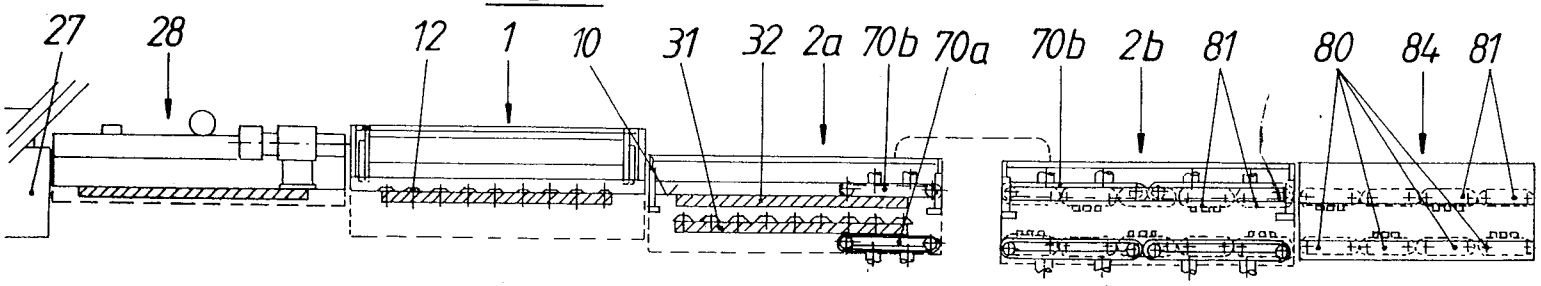

The sealing station 2 that follows the pairing station 1 in the direction of movement x consists of two substations 2*a* and 2*b* (FIG. 1). The first substation 2*a* includes a horizontal conveyor 4 which, to a very large extent, corresponds in its construction to the construction of the horizontal conveyor 3 used in pairing station 1. Similar or corresponding components are, for this reason, indicated with the same reference numbers. The horizontal conveyor 4 differs from horizontal conveyor 3 in that the frame 8 cannot be adjusted transversely to the plane of movement of the panes 10; the plane 10 in the first substation 2*a* of the sealing station coincides with the plane of movement of the panes in the supply conveyor, in the washer 27, in the intermediate conveyor 28, and in the pairing station 1 when in its forward position (FIG. 9).

Furthermore, the first substation 2*a* of the sealing station 2 differs from pairing station 1 in that two identical auxiliary conveyors 70*a* and 70*b* for the two panes 31 and 32 are provided at a slight distance above the rollers 7 of the horizontal conveyor. The auxiliary conveyors 70*a* and 70*b* are suction conveyors as are described in German patent application No. P 35 29 892.8 or in the German patent application submitted by Herr Karl Lenhardt and entitled "An Apparatus for the Smooth Conveyence of Articles in any Position, in Particular when Inclined or when Vertical," this having been submitted on the same date as the aforementioned patent application. Each auxiliary conveyor 70*a* and 70*b* consists of a hollow section beam 71, the interior space 72 of which is connected through tubular pipe sections to the suction side of the fan (not shown herein). The hollow section beams 71 extend horizontally and their working surfaces that are proximate to each other are parallel to the plane of movement of the panes 10. On each hollow section beam 71 there are, on the longitudinal sides, two endless belts 74 and 75 that can be driven synchronously with the rollers 7 and which are parallel to each other; the working side of these belts is slightly above the working surface of the hollow section beam 71 and thus, along their length, define a low pressure channel 76 that is open towards the plane of movement of the panes 10 and connected through the drillings 77 in the working surface of the hollow section beam 71 to the interior space 72 of the hollow section beam. If the low pressure channel 76 is completely or partially covered by means of a pane of glass 31 or 32, a partial vacuum will be formed in the low pressure channel 76 and this will then act on the pane of glass 31 or 32, press it against the belts 74 and 75, with the result that it is moved smoothly forward. The auxiliary conveyors 70*a* and 70*b* do not have to extend to the full length of the substation 2*a*, but they should, however, extend as far as its outlet end, since there—as has been described above—there is a nozzle which extends into the space between the two panes 31 and 32 and could hinder the movement of such panes.

Adjacent to the outlet end of the first substation 2*a* of the sealing station there is, on the horizontal conveyor 4, a device 33 for driving, guiding, and operating a nozzle 36, this being installed on a slide 34 and which, with this, can be slid up and down in a space between the first substation 2*a* and the second substation 2*b* of the sealing station, along a movement track 35, this extending perpendicularly to the direction of movement x, parallel to the plane of movement of the panes 10. On this slide 34, the nozzle 36 is arranged so as to pivot about an axis 37 that is perpendicular to the plane of movement of the panes (FIG. 7), in each instance progressively by 90°.

The two panes of glass 31 and 32 that have been positioned in the pairing station 1 at a distance from each other so as to coincide with each other are moved as a pair into the first substation 2*a* of the sealing station and there supported and guided in the same way as in the pairing station 1, this being done in addition along their lower edges with the two auxiliary conveyors 70*a* and 70*b*.

The second substation 2*b* of the sealing station is for the most part constructed in the same way as the first substation 2*a;* identical and corresponding components are, for this reason, indicated with the same reference numbers. The essential difference lies in the fact that in place of the rollers 7, the horizontal conveyor 41 in the second substation 2*b* has a vertical conveyor that incorporates separate conveyor elements 80 and 81 for the front and for the rear pane of glass 31 or 32 respectively (indicated in FIG. 8 by the dashed lines), these being, for example, endless synchronously driven chains. In the example that is shown, there are five such conveyor elements 80 or 81 for each of the two panes of glass 31 and 32, these being arranged in the direction of movement, one behind the other, and which bear grips 82, 83 with surfaces that are parallel to the plane of movement of the panes 10 which are used to support panes 31 or 32. In addition, each second conveyor element 80 and 81 bears supports 46 or 45 such that the front conveyor element 80 has no support when the opposite rear conveyor element 81 has a support 45, and vice versa. The supports 45 and 46 extend very slightly above the grips 83 or 82 such that they do not extend into the edge joint that is formed between the two panes 31 and 32. In order to permit a match to different thicknesses of insulating glass panes, the distance of the front support 46 from the rear support 45 can be varied. An example for such a conveyor element and its drive is described in DE-PS No. 34 00 031. A useable and similar horizontal conveyor with supports that are arranged in pairs opposite to each other is described in DE-PS No. 30 38 425.

The substation 2*b* has two similar auxiliary conveyors 70*a* and 70*b* in the same way as substation 2*a*, and these extend at least along a portion of the length of the substation 2*b* starting from its inlet end. It is preferred that the auxiliary conveyors 70*a* and 70*b* extend to the whole length of the substation 2*b*, in the example shown in FIGS. 8 to 16 there are in each instance two auxiliary conveyors arranged one after the other, of which each is of a length similar to the length of the auxiliary conveyors 70*a* and 70*b* in the first substation 2*a*.

In order to provide lateral support for the pane of glass 32 that is rearmost in each instance, there is a field of support rollers 9 above the supports 45 and 46, as was the case in the preceding stations 1 and 2*a*. In place of this, however, it would also be possible to provide a supporting wall formed preferably as an air cushion wall and which to this end, has distributed about its surface drillings from which air flows, this then generating a cushion of air between the supporting wall and the pane of glass that is being moved at a particular time, such that the panes of glass will float on this air. Tapered support rollers 11, as are provided in pairing station 1 and in the first substation 2*a* to support the front pane 31 along its lower edge, are not used in substation 2*b;* here, the task is taken over by the auxiliary conveyors 70*a*, which act on the front pane 31 by means of suction.

The second substation 2*b* of the sealing station 2 is followed by a withdrawal station 84, the construction of which corresponds to a very great extent to the construction of the second substation 2*b*, although this has neither the auxiliary conveyors 70*a* and 70*b* nor the upper line of support rollers 11.

As is shown in FIGS. 5 and 6, the nozzle 36 incorporates two feed channels 51 and 52, these meeting obliquely in two closely adjacent parallel long outlet slots 53 and 54 that are oriented opposite to the direction of movement of the nozzle relative to the two panes of glass 31 and 32. Various paste-like materials can be delivered through the two feed channels 51 and 52 and these then combine outside the nozzle to a strip 67 that consists of two layers 65 and 66. The plane of separation between the two layers 66 and 67 runs transversely to the plane of movement and from one pane of glass 31 to the other pane 32.

The nozzle 36 is slightly narrower than the prescribed distance between the two panes of glass 31 and 32, so that it can penetrate into the space between the panes of glass. In order that the two panes of glass 31 and 32 conform precisely to the required distance in the area of the nozzle, a spacer 55 precedes the nozzle orifices 53 and 54, this consisting, in the example that is shown, of a sliding shoe 56; the sliding shoe 56, the sides of which are at a distance that matches the prescribed interval precisely, is installed on the nozzle body. The shoe itself is of a material which has a lower coefficient of friction that glass. Because of the fact that it is installed on the nozzle body, it can be very easily replaced as it wears because of friction. In order that the spacer 55 can be inserted very easily into the space between the two panes of glass 31 and 32, the shoe 56 has a taper 68 on those edges with which it penetrates into the space between the panes of glass.

On both sides of the spacer 55 there are two free-wheeling pressure rollers 57 and 58, the axes of rotation 59 and 60 of which are parallel to the plane of movement of the panes 10. These pressure rollers 57 and 58 press the two panes of glass 31, 32 against the spacer 55, thereby ensuring that it is kept at the proper distance, so that the connector strip 67 can be produced at the required width that corresponds to this distance.

In order to make it possible to move the pressure rollers 57 and 58 towards and away from the pane of glass, they are supported in a carrier 50 so that they can move in a direction perpendicular to the plane of movement of the panes 10; this carrier 50 encloses the edge of the pair of panes 31, 32 in the manner of a clip. Since the rearmost pane 32 in the horizontal conveyor 3, on which the nozzle 36 is arranged, is always in a constant position that is determined by the plane of movement 10, it is only necessary to provide the pressure roller 57 that is located behind the plane of movement 10 with a very limited amount of movement of, perhaps, only 0.5 mm. A greater amount of movement is provided for the opposite pressure roller 58 so that it can match the varying thicknesses of panes of insulating glass. The axes 59 and 60 of the two pressure rollers are connected to each other by means of a pneumatic piston-cylinder 62, 63, e.g., in such a way that the piston rod 63 is connected with the axis 59 of the rearmost pressure roller and the cylinder 62 is connected with the axis 60 of the front pressure roller. The two pressure rollers 57 and 58 are thus operated jointly by the piston-cylinder unit 62, 63 that is connected above them. Before the nozzle enters the space between the two panes 31 and 32, the pressure rollers 57 and 58 are at their greatest distance and once penetration has taken place, they are pressed pneumatically against the two panes of glass.

As the nozzle 36 moves around the corners of the panes of glass 31, 32 the nozzle body only moves partially out of the space between the two panes; as can be seen in FIG. 7, the section of the nozzle 36 in which the outlet orifices 53 and 54 are located remains between the panes 31, 32. The nozzle 36 can be pivoted about an axis 37 that is perpendicular to the plane of movement of the panes 10, which is close to the outlet orifice 54 which penetrates the deepest into the space between the two panes of glass 31, 32. Furthermore, the position of the axis of rotation 37 is so selected that it is approximately in alignment with the surface 69 of the connect strip 67 that is proximate to the interior space of the insulating pane of glass; the pivoting of the nozzle 36 takes place from a position in which the axis 37 is at an equal distance from the two limiting edges of the pane of insulating glass that is formed by the panes of glass 31, 32 (see FIG. 7); this ensures that an optimal configuration of the connect strip 67 is achieved in the corner areas of the pane of insulating glass.

As is shown in FIG. 7, the spacer 55 moves out of the space between the two panes 31 and 32 on approaching a corner of the panes; this means that during each pivoting movement of the nozzle 36, the pressure rollers 57 and 58 first move away from each other and then, after the pivoting movement, must be moved towards each other once again in order that the panes of glass 31 and 32 are once again pressed against the spacer 55.

The nozzle 36 is attached to the carrier 50 in the same way as the pressure rollers 57 and 58 and, together with these, can be pivoted about the axis 37. In its turn, the carrier 50 is attached to the slide 34 (FIG. 1); the carriage 34 itself cannot be pivoted.

In order to achieve a match to the panes of glass 31 and 32 that are of various thicknesses, the nozzle 36 is arranged so as to be adjustable on the carrier 50 in a direction that is perpendicular to the plane of movement of the panes 10 (part 64). In order to provide a match to varying distances between the panes of glass 31 and 32, the nozzle 36 can be replaced by nozzles that are either wider or narrower.

The sequence for constructing a pane of insulating glass will be described below on the basis of FIGS. 8 to 16 as such a sequence applies to an assembly line which operates with only one nozzle 36. The sequence until the two panes of glass 31 and 32 are positioned so as to cover each other with a space between them in the pairing station 1 is described later, so that the following description can start with its initial point in FIG. 9. The two panes of glass 31 and 32 that are positioned in the pairing station are moved together into section 4 of the horizontal conveyor that is located in the first substation 2*a* of the sealing station, and are then moved further into section 41 of the horizontal conveyor in the second substation 2*b* of the sealing station. Within the pairing station 1 the frame 8 is moved back into its starting position (as in FIG. 8) so that the first pane of glass of the next pair of panes can move into position.

Figure 11:
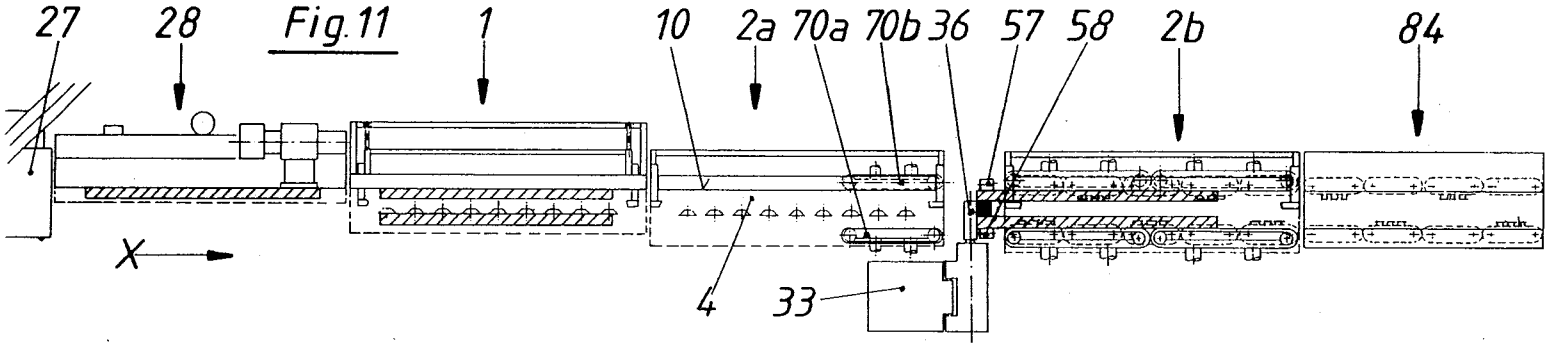
Figure 12:
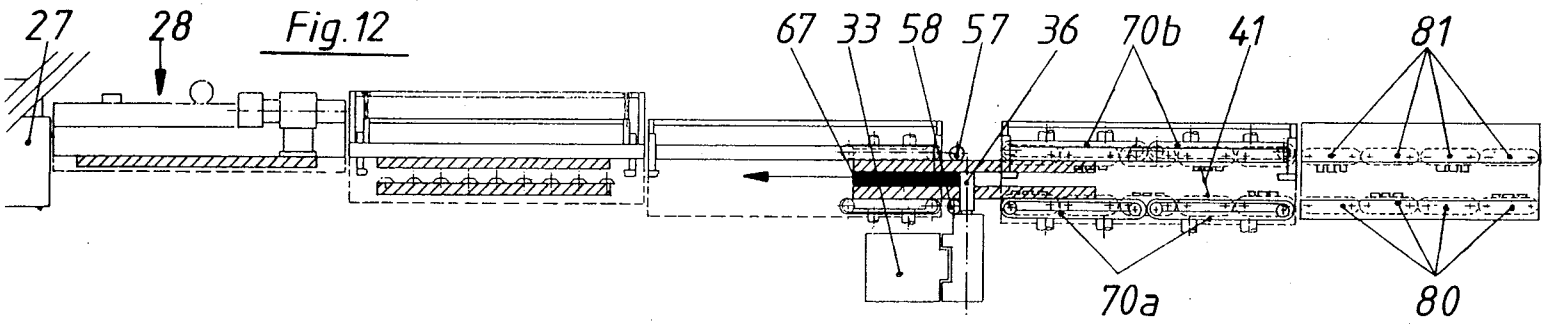
Figure 13:
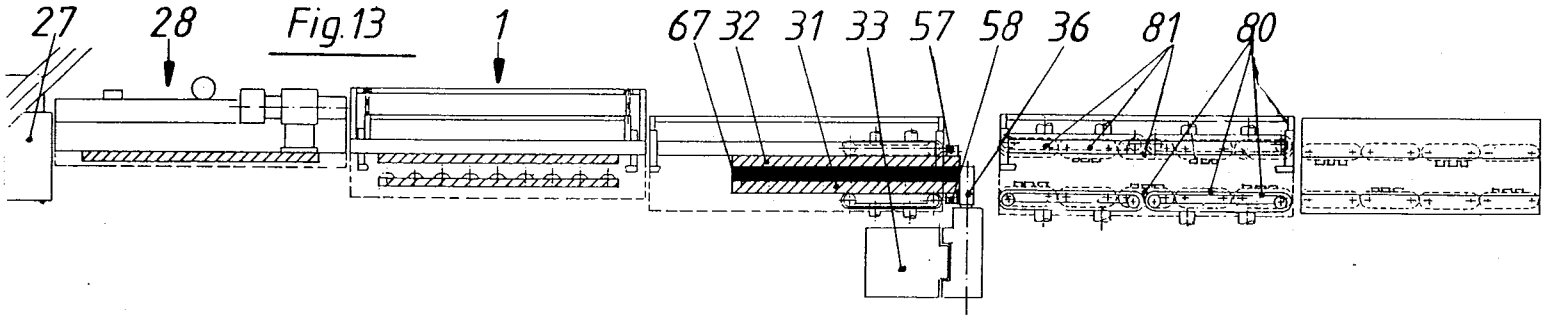
Figure 14:
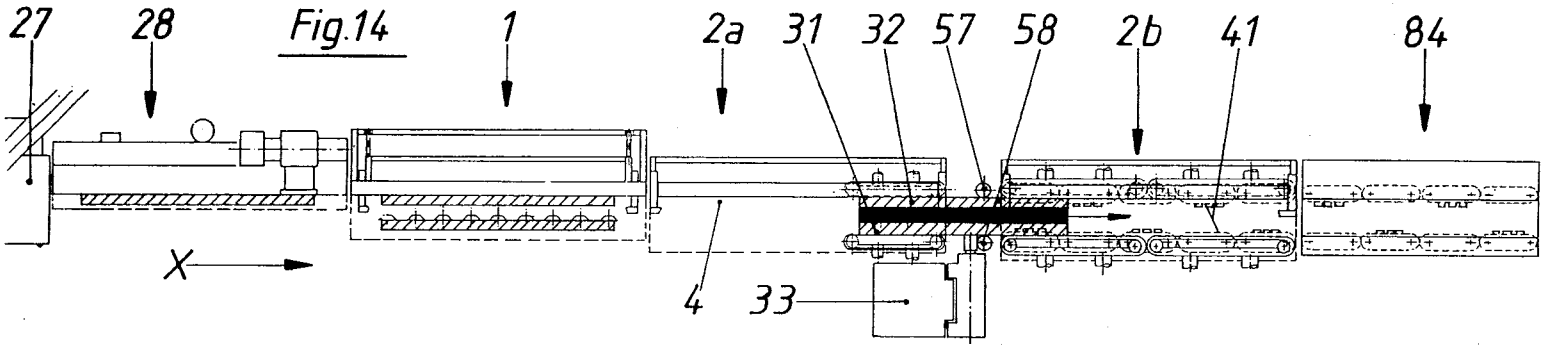

The pair of panes 31 are moved through the horizontal conveyor 41 into a position in which the panes 31 and 32 lie with their lower edge that extends from above downwards in the pre-determined position in the space between the horizontal conveyors 4 and 41; this position is shown in FIG. 11. In this position, the nozzle 36 is directed to the rearmost lower corner of the panes 31 and 32 by means of the device 33, whereupon it enters the space and moves on the rear edge of the panes of glass up to the rearmost upper corner and in so doing produces a strip 67 that extends from below towards the top, from a mass which is at first paste-like and is located between the two panes 31 and 32. On reaching the uppermost rear corner, the upwards movement of the nozzle is stopped and this, as is shown in the detailed drawing in FIG. 7, is then pivoted clockwise through 90°. The stop command for the nozzle drive can be generated by a sensor which moves ahead of the nozzle 36 at a pre-determined distance and which responds to the position of the panes of glass 31 and 32. However, it is also possible to control the nozzle on the basis of previously-made measurements of the format of the pane of glass, when path-follower sensors are used. Once the nozzle 36 has completed its pivoting movement which is, for example, signalled by means of a limiting switch, the pair of panes 31 and 32 is moved back from the horizontal conveyor 41 to the horizontal conveyor 4 and taken over by this (see FIG. 12), after which the upper support row of support rollers 12 in the horizontal conveyor 4 are raised so that these support rollers can no longer engage in the space between the two panes of glass 31 and 32, which is now filled with the hardening mass. In this phase of the assembly, the two panes of glass 31 and 32 are held along the lower edge by means of the lower support rollers 11 in the horizontal conveyor 4 and by the auxiliary conveyors 70*a* and 70*b*, on the lower edge and on the upper edge in the area between the rearmost upper corner and the nozzle 36 by means of the strip 67 that has already been produced, and in the area from the nozzle 36 to the foremost upper corner by the spacer 55 that is associated with the nozzle 36 and by the upper support rollers 12 in the horizontal conveyor 41. The rearward movement of the pair of panes 31, 32 is continued until it reaches the position shown in FIG. 13, in which the nozzle 36 has reached the rearmost upper corner and the foremost edge of the panes 31, 32 lies at the predetermined place in the area between the horizontal conveyors 4 and 41. With the pair of panes 31, 32 stationary, the nozzle 36 is pivoted once more counterclockwise through 90° and then moves along the forward edge upwards along the pair of panes until it reaches the lower foremost corner of the pair of panes (FIG. 13).

Figure 15:
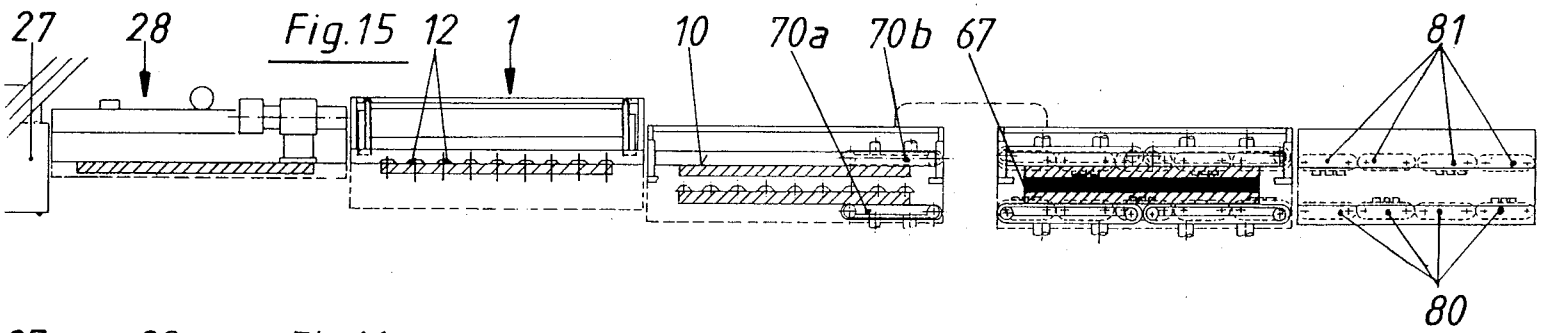

With the pair of panes 31, 32 remaining stationary, the nozzle 36 is pivoted once more clockwise through 90° and subsequently the pair of panes 31, 32 is moved in the direction indicated by the arrow x with a simultaneous injection of the paste-like mass into the space, along the lower edge of the panes, which once more enter the area of the horizontal conveyor 41 where they are taken over by this. The panes 31, 32 can run the whole length of the horizontal conveyor 41 without stopping since when the nozzle reaches the rearmost lower corner, the sealing process is ended and the nozzle is automatically closed. The nozzle is then rotated once more through 90° in a clockwise direction and is then ready to seal the next pair of panes which have in the meantime entered the horizontal conveyor 4 (FIG. 15).

Figure 16:
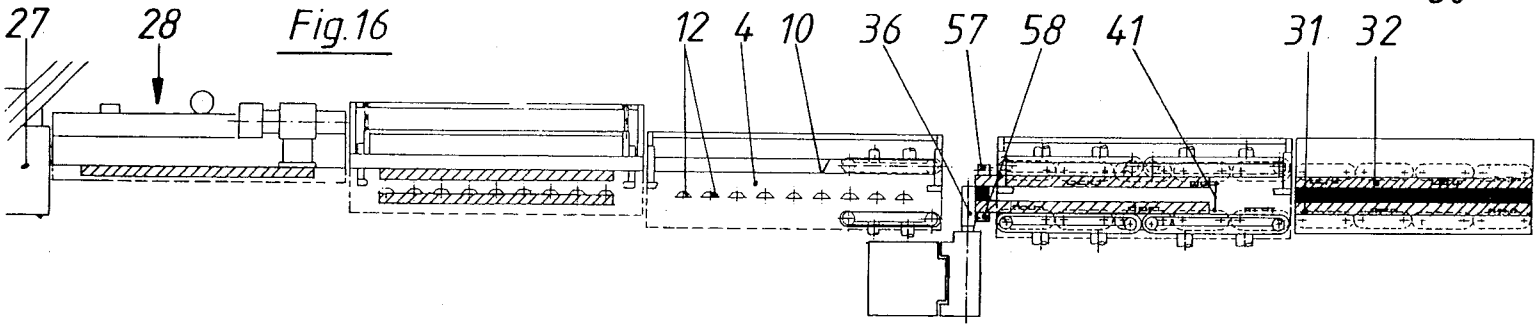
Figure 17:
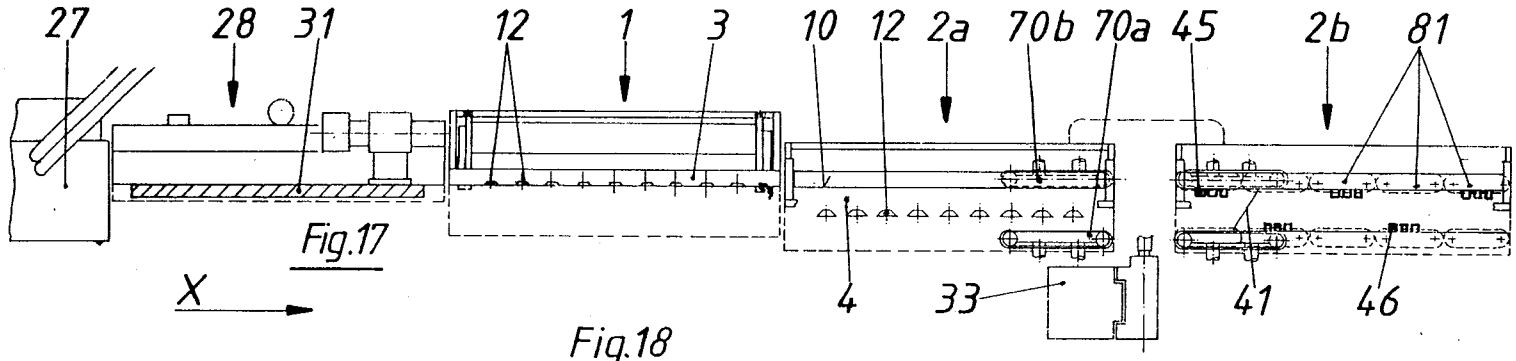

The sealed pane of insulating glass that is formed from the panes 31 and 32 passes from the second substation 2*b* of the sealing station into the removal station 84 and is there stopped (FIG. 16). At the same time, the next pair of panes can move into the horizontal conveyor 41, whereupon the sealing process starts (as is shown in FIG. 11); at this time, the insulating glass pane that has been produced is lifted from the removal station 84 and moved to a storage area.

FIGS. 17 to 23 show the course of the assembly of an insulating pane of glass in an assembly line which operates with two nozzles. The construction of the assembly line corresponds to a very great extent to the construction of the assembly line which has been described above in connection with FIGS. 1 to 16. Identical or corresponding parts bear the same reference numbers and will not be described in detail below. The assembly lines that are shown and operate with one and with two nozzles are the same with regard to the washer 27 and in the intermediate conveyor 28 (neither of which are objects of the present invention), in the pairing station 1 and in the first substation 2*a* of the sealing station and to a very great extent are the same in the second substation 2*b* of the sealing station; the difference between the second substation 2*b* lies in the fact that it contains only one pair of auxiliary conveyors 70*a* and 70*b*. In addition, there is no removal station 84 and the assembly line uses two nozzles.

Of the two nozzles in the second assembly line, one nozzle 36 is built, arranged and moved in the same manner as the nozzle 36 in the first assembly line; this one nozzle 36, however, serves in the two-nozzle assembly line only to seal the insulating pane of glass along its forward, upper and rearmost edge. A second nozzle 36*a* is provided to seal the lower edge of the insulating pane, and this is built in the same way and has the same spacer 55 and pressure rollers 57 and 58 as are shown in FIGS. 5 and 6. The second nozzle 36*a* is, however, only moveable up and down parallel to the plane of movement of the panes to a limited extent, namely, from a resting position beneath the set-up plane of the horizontal conveyor 4 or 41, into a working position in which the nozzle 36*a* extends above the set-up plane of the horizontal conveyor by the extent to which it is intended to penetrate in the space between the panes of glass 31, 32. Since the second nozzle 36*a* is located beneath the first nozzle 36, it is to a very large extent covered by the upper nozzle 36 as can be seen from the plan view as is shown in FIGS. 17 to 23.

Figure 18:
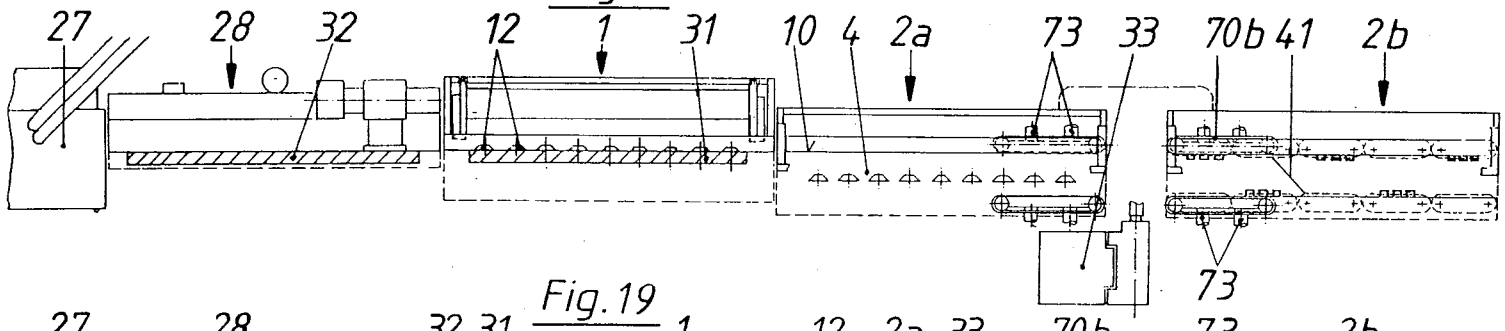
Figure 19:
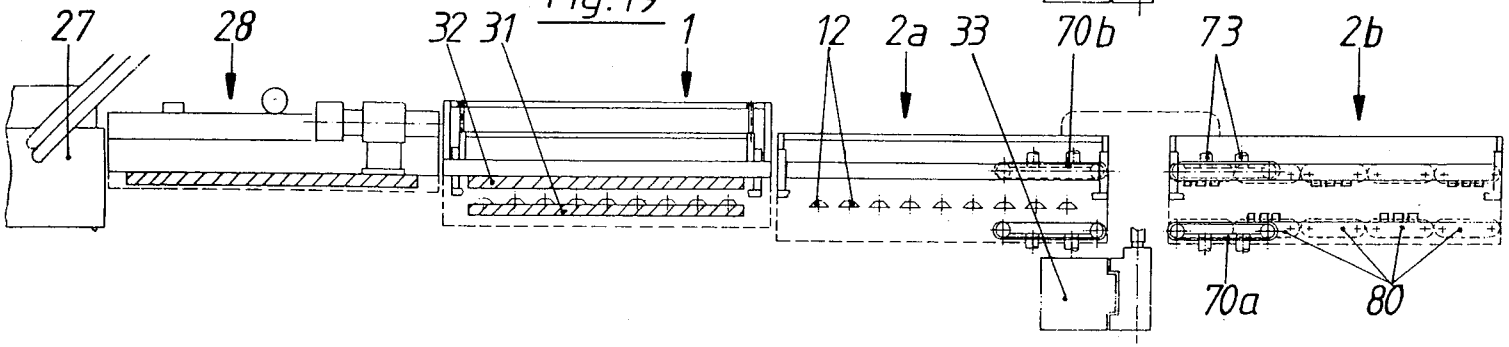
Figure 20:
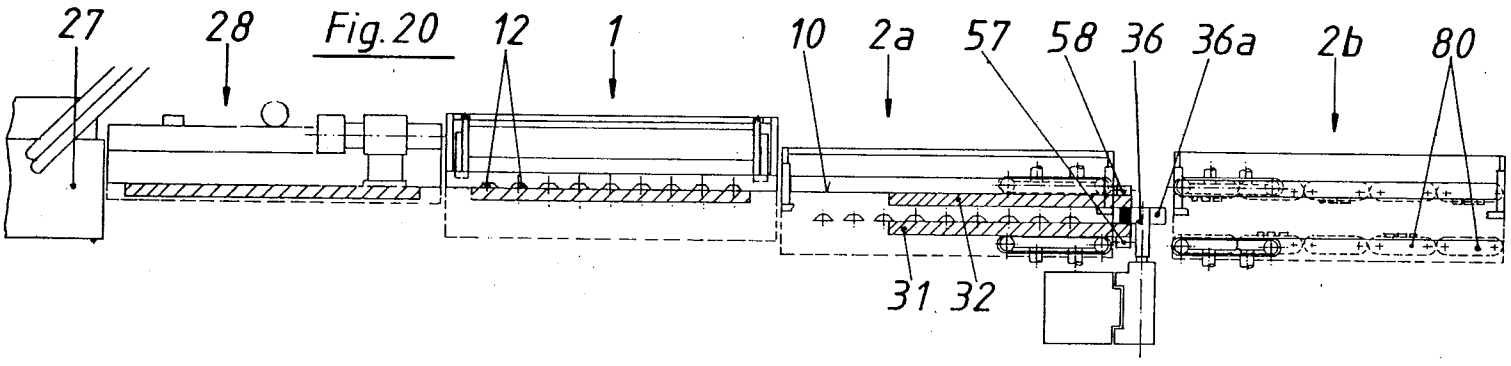

An insulating pane of glass is assembled in the following sequence: the positioning of the two panes of glass 31 and 32 so as to cover each other and be at a distance from each other is effected in exactly the same way as in the first assembly line; the sequences that are shown in FIGS. 18 and 19 correspond completely to those that are shown in FIGS. 8 and 9, so that reference can be made to these. The glass panes 31 and 32 that are positioned at a distance from each other so as to cover each other are moved from the pairing station 1 into the following horizontal conveyor 4 and from there into a pre-determined end position in which the front edge of the two panes of glass 31 and 32 extend slightly beyond the end of the horizontal conveyor 4 in the space between the horizontal conveyors 4 and 41 (FIG. 20). In this position, the rear pane of glass 32 is supported by the set of supporting rollers that is made up of the supporting rollers 9 whereas, on the other hand, the pane of glass which is at the front is supported by the upper and lower lines of supporting rollers 12 or 11. In this position of the panes of glass 31 and 32 the upper nozzle 36 is introduced into the area of the foremost lower corners of the panes in the space that lies between them and is then moved along its path of movement 35 upwards, whereupon it injects a strip 67 of paste-like material along the forward edge of the pair of panes. At the same time, the frame 8 is moved back in the pairing station 1 so that the first pane of glass of the next pair of panes, inclined against the lines of supporting rollers 11 and 12, can be moved into position (FIG. 20). At this same time, the lower nozzle 36*a* is moved upwards from its rest position and enters the area of the lower foremost corner of the pair of panes 31, 32, into the space that is left between them.

Figure 21:
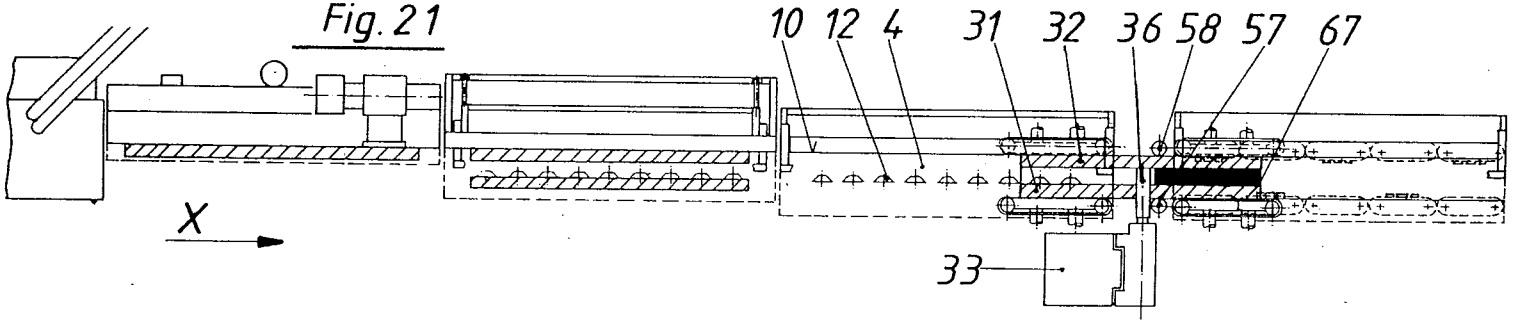
Figure 22:
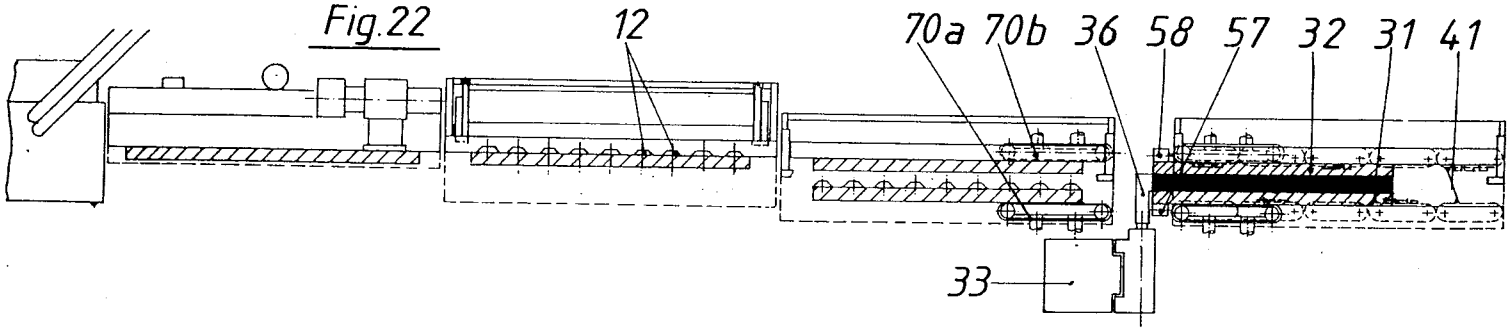

As soon as the upper nozzle 36 has reached the upper corner of the pair of panes 31, 32, its motion is stopped and it is rotated 90° in a counter clockwise direction, whereupon during the pivoting movement the egress of paste-like material is best interrupted so as to prevent the edge joint in the corner areas being overfilled. Once this pivoting motion of the upper nozzle 36 has been terminated, the pair of panes 31, 32 is moved on by the horizontal conveyor 4 in the direction of movement x and transferred to the subsequent synchronously driven horizontal conveyor 41. During this forward movement, paste-like material is injected by the two nozzles 36 and 36*a* simultaneously along the upper and lower edges of the pair of panes 31, 32, this being injected into the space that is formed between them (FIG. 21). During this forward movement, the two panes 31 and 32 are held in the area that the nozzles 36, 36*a* have already passed, by means of the strip 67 which has been formed there, and in addition by the suction effect of the auxiliary conveyors 70*a*, 70*b* which also retains them at the proper distance from each other; within the area that the nozzles have no yet passed, the panes 31 and 32 are kept at the correct distance from each other by the spacer 55 that precedes the nozzle orifices as well as by the upper and lower support rollers 11 and 12 in the area of the horizontal conveyor 4. Once the two nozzles 36, 36*a* have reached the two rearmost corners of the pair of panes 31, 32, the pair of panes is halted by interrupting the drive to the horizontal conveyor 41 and at the same time the supply of paste-like mass to the two nozzles 36, 36*a* is interrupted. The upper nozzle 36 is once again rotated through 90° in a clockwise direction and begins to move along the rear edge of the pair of panes 31, 32 and thus seal the rear edge joint (FIG. 22); during this time, the lower nozzle 36*a* moves back into its rest position. At the same time, the next pair of panes that is to be sealed can be moved into the area of the horizontal conveyor 4.

Figure 23:
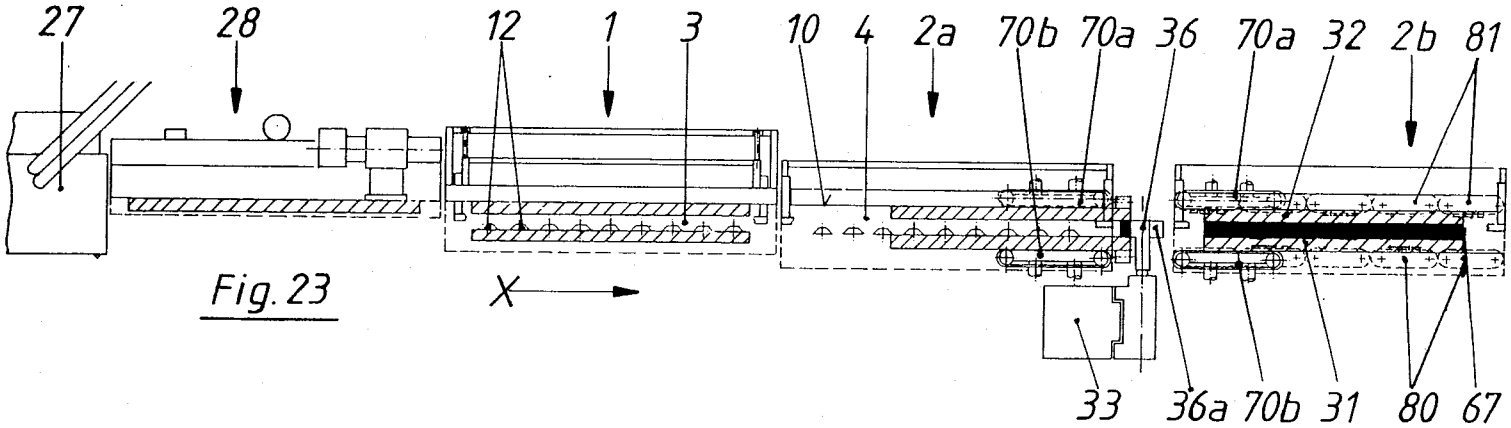

As soon as the upper nozzle 36 has reached the rearmost lower corner of the pair of panes 31, 32, it is stopped and the further supply of paste-like material is interrupted. The now ready insulating pane of glass can be moved off by horizontal conveyor 41 or can be taken off this in order to be moved into a storage area (FIG. 23). The upper nozzle 36 is rotated through 180° and introduced into the area of the foremost lower corner in the space between the two following panes of glass (FIG. 23).

In both these assembly lines, it would be possible to dispense with the horizontal conveyor 4 and provide the sealing nozzles together with their device 33 for driving, guiding and operating the nozzles 36*a*, 36 in appropriate places at the end of the pairing station. The course of movement that is usually completed by the horizontal conveyor 4 must then be carried out in the pairing station 1, for which this is particularly well suited. In all events, during this time the two subsequent panes of glass can still not be paired, so that the cycling time for the assembly line will be extended correspondingly.

I claim:

1. An apparatus for joining two panes of glass to form an edge-sealed pane of insulating glass by the injection of a strip of material, said material being initially paste-like and subsequently hardening and adhering to the two panes of glass to its whole extent along the edge of the panes in the space between the two panes that are, at least on one of their major surfaces, supported and aligned, and held at a distance from each other so as to be parallel, with at least one nozzle that is arranged on a horizontal conveyor for the two panes that are held at a distance from each other, characterized in that the horizontal conveyor (3, 4, 41) is provided with supporting elements (9; 11, 12) that are separated over one of their major surfaces, of which some define a plane hereinafter referred to as the plane of movement of the panes (10), whereas the other define a plane that is parallel thereto, these being moveable by means of an operating system, either individually or in groups, out of engagement with the pane of glass (31) that is arranged at a distance from the plane of movement of the panes (10); in that the one nozzle (36), in the case of a plurality of nozzles (36, 36*a*) at least one (36) of them, being moveable parallel to the plane of movement of the panes (10) at least transversely to the direction of movement (x) of the horizontal conveyor (3, 4, 41); and in that the outlet orifices (53, 54) of each nozzle (36, 36*a*) are provided with a separator (55) that precedes them, and which penetrates the space between the two panes of glass (31, 32).

2. An apparatus as in claim 1, characterized in that the supporting elements of the horizontal conveyor are so arranged that they define a horizontal plane of movement for the panes and a second plane that is parallel to and above this plane.

3. A device according to claim 2, characterized in that a parallel suction system that can be moved parallel to and transverse to the plane of movement of the panes is provided above the plane of movement of the panes and which can be applied to the upper pane of glass.

4. An apparatus according to claim 1, characterized in that the supporting elements (9, 11, 12) of the horizontal conveyor (3, 4, 41) are so arranged that they define a vertical or, preferably, approximately vertical plane of movement for the panes (10) and a second plane that lies in front of and parallel to this.

5. An apparatus according to claim 4, characterized in that the horizontal conveyor incorporates a vertical conveyor (7) with a set-up plane that extends at right angles to the plane of movement of the panes (10) on which the panes of glass (31, 32) rest on their lower edge.

6. A device according to claim 5, characterized in that the horizontal conveyor (4, 41) has above the vertical conveyor (7) an auxiliary conveyor (70*a*, 70*b*) that is driven synchronously with the vertical conveyor (7) that is intended to act on the rearmost or foremost edge of the panes of glass (31, 32) or on the outer major surface of the panes of glass (31, 32).

7. An apparatus according to claim 6, characterized in that the auxiliary conveyor (70*a*, 70*b*) is formed from two suction conveyors that are arranged on both sides of the plane of movement of the panes (10) and opposite to each other.

8. An apparatus according to claim 6, characterized in that an auxiliary conveyor (70*a*, 70*b*) that lies in front of the path of movement (35), viewed in the direction of movement (x), of the nozzle (36) that can be moved transversely to the direction of movement (x) and a second auxiliary conveyor (70*a*, 70*b*) that is behind the path of movement (35), viewed in the direction of movement (x), of the nozzle (36) that can be moved transversely to the direction of movement (x) is provided.

9. An apparatus according to claim 1, characterized in that the supporting elements (9, 11, 12) that are used to move the panes of glass (31, 32) can be driven.

10. A device according to claim 1, characterized in that the supporting elements (11, 12) for the pane of glass (31) that is arranged at an interval from the plane of movement of the panes (10) are rollers that penetrate the space between the two panes of glass (31, 32).

11. An apparatus according to claim 1, characterized in that pressure elements (57, 58), in particular rollers, are arranged on both sides of the separator (55).

12. An apparatus according to claim 11, characterized in that the pressure elements (57, 58) can be moved towards each other and away from each other by means of a pneumatic piston-cylinder unit (61, 62, 63).

13. An apparatus according to claim 12, characterized in that the piston (61) of the piston-cylinder unit is connected to the pressure element or pressure elements (57) on the one side, and the cylinder (62) is connected with the pressure element or pressure elements (58) on the other side of the plane of movement of the panes (10).

14. An apparatus according to claim 1, characterized in that the nozzle (36, 36*a*) and the separator (55) that precedes it, are arranged on a common carrier (50).

15. An apparatus according to claim 1, characterized in that the nozzle (36, 36*a*) itself forms the separator.

16. An apparatus according to claim 1, characterized in that the separator (55) consists, at least on its sides, of a plastic having a low coefficient of friction.

17. An apparatus according to claim 1, characterized in that the outlet orifice or outlet orifices (53, 54) of the nozzle (36, 36*a*) that penetrates into the space between the two panes of glass (31, 32) is/are oriented opposite to the direction of relative movement of the nozzle (36, 36*a*) relative to the panes of glass (31, 32).

18. An apparatus according to claim 1, characterized in that the moveable nozzle (36) can be pivoted about an axis (37) that is perpendicular to the plane of movement of the panes (10) sequentially by, in each instance, an angle of 90°.

19. An apparatus according to claims 11, 14 or 18, characterized in that the nozzle (36), the separator (55) that is optionally formed separate from this, and the pressure elements (57, 58) are arranged on a common carrier (50) and can be moved and pivoted with this.

20. An apparatus according to claim 1, characterized in that the nozzle (36, 36*a*) has two outlet orifices (53, 54) that are closely adjacent.

21. An apparatus according to claim 20, characterized in that the two feed channels (51, 52) that open out into the two outlet orifices (53, 54) are arranged in the nozzle (36) so as to meet obliquely.

22. An apparatus according to claim 1, characterized in that two feed channels are arranged in the nozzle (36, 36*a*), these opening out into a common nozzle orifice.

23. An apparatus according to claim 1, characterized in that the supporting elements (11, 12) that hold the front or upper pane of glass (31) at a distance from the other pane of glass (32) touch these only in the vicinity of the edge.

24. An apparatus according to claim 1, characterized in that the distance of the supporting elements (11, 12) for the foremost or the upper pane of glass (31) can be varied from the plane of movement of the panes (10).

25. An apparatus according to claim 1, characterized in that two rows of supporting elements (11, 12) are provided for the lateral support of the pane of glass (31) that is arranged in front of the plane of movement of the panes (10), these being parallel to the direction of movement of the horizontal conveyor (3, 4, 41) of which at least one can be moved parallel to the plane of movement of the panes (10) transversely to the direction of movement (x).

26. An apparatus according to claim 5 or claim 25, characterized in that a row of supporting elements (11) projects only slightly above the set-up plane of the horizontal conveyor (3, 4, 41) and the other row of supporting elements (12) can be adjusted for height above this.

27. An apparatus according to claim 26, characterized in that the supporting elements (11) for the lower edge of the foremost pane of glass (31) can be lowered beneath the set-up plane of the horizontal conveyor (3, 4, 41).

28. An apparatus according to claim 18, characterized in that the horizontal conveyor has at least two separate and driveable sections (3, 4) that are arranged one behind the other; in that the supporting elements (11, 12) for the major surface of the pane of glass (31) that are arranged in the first sector (3) of the horizontal conveyor can be adjusted separately from that in the second section (4); and in that the first sector (3) of the horizontal conveyor, together with its supporting elements (9, 11, 12) for the two panes of glass (31, 32) are moveable in a direction that is perpendicular to the plane of movement of the panes (10).

29. An apparatus according to claim 28, characterized in that the first sector (3), the horizontal conveyor for the two panes of glass (31, 32) has two separate vertical conveyors, these being arranged next to each other and parallel to each other, and which can be selected so as to be driveable together and synchronously.

30. An apparatus according to claim 28 with only one nozzle (36) or with two nozzles (36, 36*a*) of which one (36) is arranged at the level of the vertical conveyor (7), and is provided only to produce a strip (67) along the lower edge of the panes of glass (31, 32), characterized in that the nozzles (36, 36*a*) viewed in the direction of movement (x) are arranged adjacent to the second sector (4) of the horizontal conveyor, and in that a third sector (41) of the horizontal conveyor is adjacent to this.

31. A device according to claim 28, characterized in that the vertical conveyor has supports (45, 46) in the last sector (41) of the horizontal conveyor, these gripping the panes of glass (31, 32) without disturbing the lower edge joint formed between them.

* * * * *